US006844860B2

(12) United States Patent
Mann et al.

(10) Patent No.: US 6,844,860 B2
(45) Date of Patent: Jan. 18, 2005

(54) TRANSDUCER WITH FIELD EMITTER ARRAY

(76) Inventors: Christopher Mann, 38 Coxwell Street, Farringdon, Oxfordhire SN7 7HA (GB); Syed Ejazul Huq, 11 Sewell Close, Abingdon OX143YJ, Oxon (GB); Martyn Chamberlain, 18 St. Helens Gardens, Adel, Leeds, Yorkshire LS16 8BT (GB); John Fletcher, 421 Derby Road, Nottingham, Nottinghamshire, NG7 2EB (GB)

( * ) Notice: Subject to any disclaimer, the term of this patent is extended or adjusted under 35 U.S.C. 154(b) by 190 days.

(21) Appl. No.: 10/203,493

(22) PCT Filed: Feb. 8, 2001

(86) PCT No.: PCT/GB01/00508

§ 371 (c)(1),
(2), (4) Date: Dec. 24, 2002

(87) PCT Pub. No.: WO01/59802

PCT Pub. Date: Aug. 16, 2001

(65) Prior Publication Data

US 2003/0132887 A1 Jul. 17, 2003

(30) Foreign Application Priority Data

Feb. 9, 2000 (GB) ..... 0003060

(51) Int. Cl.[7] ..... H01Q 13/10; H01P 11/00

(52) U.S. Cl. ..... 343/767; 29/600

(58) Field of Search ..... 343/767, 907; 29/600, 847, 852

(56) References Cited

U.S. PATENT DOCUMENTS 5,355,093 A * 10/1994 Treado et al. ..... 330/45
6,333,598 B1 * 12/2001 Hsu et al. ..... 313/495
6,369,505 B2 * 4/2002 Tjaden et al. ..... 313/495
6,590,322 B2 * 7/2003 Hsu ..... 313/310

* cited by examiner

*Primary Examiner*—Shih-Chao Chen
(74) *Attorney, Agent, or Firm*—Patzik, Frank & Samotny Ltd.

(57) ABSTRACT

A transducer suitable for generating signals in the terahertz region has a resonant cavity (4) with apertures (6) aligned with cold cathode source (2) being a field emitter array. The resonant cavity (4) consists of an inner cylindrical region (8) and an outer toroid region (9) that includes a slot antenna (11). To achieve signal generation in the terahertz region, the cavity (4) is fabricated using an etched polymeric material.

16 Claims, 6 Drawing Sheets

TRANSDUCER WITH FIELD EMITTER ARRAY

This application is a national phase application of International Application PCT/GB01/00508, filed Feb. 8, 2001, and which claimed priority on GB 0003060.1, filed Feb. 9, 2000.

BACKGROUND OF THE INVENTION

The present invention relates to a transducer that employs a field emitter array as a source of electrons and is suitable for use in the submillimetre wavelength region of the electromagnetic spectrum and to a method of making the same. Particularly, but not exclusively, the present invention relates to a generator that is capable of producing signals in the 300 GHz to 10 THz frequency region of the electromagnetic spectrum. This region comprises the submillimetre wavelength region (300 GHz–3 THz) and part of the far infrared region (3 THz–10 THz), but is loosely termed the "terahertz" region.

The 300 GHz to 10 THz spectral range lies at the cross-over between conventional electronics and optics and to date fundamental sources of power in this spectral range have been expensive and bulky. This has limited technology operating in this spectral range to applications in specialist areas for examples solid state science and astronomy. No low-cost, compact, convenient fundamental sources exist and this paucity of sources has given rise to the term "terahertz gape".

Conventional generators capable of generating signals at the lower end of the terahertz gap are generally transit-time devices such as bipolar transistors or Gunn oscillators. However, such devices are small and difficult to fabricate and are only capable of generating low power due to fundamental considerations of quantum mechanics and currently insurmountable technical fabrication difficulties. At the upper end of the terahertz gap optical sources are usually employed. However, these too are inherently weak sources and are subject to fundamental physical limitations. All-optical generation of terahertz pulses has recently been demonstrated, see for example "T-Ray Imaging" by Daniel Mittleman, Rune H Jacobsen and Martin C Nuss in Journal of Selected Topics in Quantum Electronics 2(3) p 679 and generation of terahertz pulses by multiplication of fundamental frequency sources, X Melique, C Mann, P Mounaix et al IEEE Microwave and Guided Wave Letters, 8 384–386 (1998) has also been described. However, the expense and/or size of the equipment described in these articles means that they are unsuitable for wider use in commercial or mass-market applications. Thus it can be seen that research into generators for this range of frequencies has focussed on developing unique devices utilising physical characteristics specific to these frequencies and research continues into pushing laser frequencies further into the far infrared.

Field emitter arrays are increasingly being used in a wide variety of applications. The use of a field emitter array as part of a generator is known but only in relation to generators operating at the much lower microwave frequencies. For example an article entitled "Application of Gated Field Emitter Arrays in Microwave Amplifier Tubes" by S G Bandy, M C Green, C A Spindt et al in Proc. $11^{th}$ Int. Conf. On Vacuum Microelectronics, p132 describes the use of a field emitter array to provide electrons for a conventional klystron-type structures milled from metal using conventional techniques. However, this generator is only capable of generating signals around 10 GHz, well outside the terahertz gap in the far infrared.

There are, however, many advantages to systems operating in the terahertz gap. For imaging systems, for example, the advantages include the comparability of the possible resolution obtainable with the size of everyday objects and the ability of the radiation to penetrate many commonly-used materials or substances such as plastics, foodstuffs, fabrics, teeth and human skin. Terahertz radiation (unlike x-ray radiation) is non-ionising and therefore presents none of the hazards directly arising from ionising radiation. Advantages for other types of application, for example communication systems, are described in "New Directions in Terahertz Technology" by J M Chamberlain, Kluwer, 1997.

There is therefore a need, that is currently not being met, for a new terahertz generator capable of generating signals in the terahertz gap that is suitable for commercial applications and for mass production.

SUMMARY OF THE INVENTION

The present invention seeks to meet this need and in particular seeks to provide a transducer that is suitable for operation over the range 100 GHz to 100 THz.

The present invention provides a method of fabricating a transducer comprising the steps of: providing a field emitter array for generating a beam of electrons; constructing a hollow cavity having one or more first apertures in a wall of the hollow cavity and an output for electromagnetic radiation; and positioning the hollow cavity such that the one or more apertures intersect the beam of electrons from the field emitter array, the cavity having metallic walls constructed using a polymeric material that is etched to produce a former of the desired shape of at least part of the cavity.

Preferably, the hollow cavity is constructed using a plurality of formers each fabricated to define different regions of the cavity and the walls of the hollow cavity are constructed by coating the exposed surfaces of the formers with a metallic material; etching the metallic coatings; and subsequently dissolving the formers leaving the desired hollow metallic structure.

Ideally, the metallic coatings are electroplated to provide additional mechanical strength. Also, the polymeric material is preferably a positive photoresist that is lithographically etched to the desired shape.

In a preferred embodiment one or more second apertures in the hollow cavity are provided, opposite the one or more first apertures, and a reflector is mounted on the outside of the hollow cavity beyond the one or more second apertures. Usefully, an electrically insulating wall is provided on the outside of the hollow cavity about the one or more second apertures on which the reflector is mounted.

Additionally, the output for electromagnetic radiation is provided in a wall of the hollow cavity opposite the wall in which the one or more first apertures are located and ideally the output is in the form of a slot antenna.

In an alternative aspect the present invention provides a transducer comprising a field emitter array for providing a beam of electrons and a hollow cavity having one or more first apertures located so as to intersect the beam of electrons from the field emitter array and an output for electromagnetic radiation wherein the hollow cavity has metallic walls constructed about a former of removable etched polymeric material.

Preferably, the output for electromagnetic radiation is located in a wall of the hollow cavity opposite the wall having the one or more first apertures such that emission of the electromagnetic radiation is in a direction substantially parallel to the beam of electrons from the field emitter array.

Ideally, the dimensions of the transducer are selected such that the transducer operates in the frequency range 300 GHZ to 10 THz.

Electron focusing means may be provided between the field emitter array and the one or more first apertures in the hollow cavity.

In practice, the upper limit of frequency of operation is set by the minimum feature sizes and reproducibility characteristics of the resists used in fabrication; this effectively limits the upper frequency of sources made by this method to about 3 THz. The lower limit is set by the ratio $\delta/\gamma$, see FIG. 1, and the maximum reasonable height of resist which this method can produce. In practice, this means a lower limit of around 100 GHz. Examples for the dimensions of generators fabricated using the method of the present invention are given later in Table 1 for frequencies of 300 GHz, 500 GHz and 1 THz. It should be noted though that the choice of the re-entrant cavity design is not essential, many other types of structure (possible extending beyond the frequency limits set out above) can be made using the lithographic micromachining method described herein. More preferably, the transducer generates electromagnetic radiation in the frequency range 300 GHZ to 1 THz.

The present invention provides a device that is compact and capable of operation at relatively low voltages whilst offering output powers in the millwatt range. Furthermore, the transducer of the present invention is fabricated on a substrate and so is suitable for mass-production at much less cost than conventional sources in the terahertz gap. The fact that the transducer is fabricated on a substrate also results in vertical emission of radiation from the cavity. This is particularly an advantage where the transducer is arranged to function as a generator. Thus, an array of generators can be fabricated on a single wafer and the power from each of the generators combined using an additional lens arrangement mounted above the generators. Furthermore, it should be noted that the present invention is suitable for integration with other devices such as a mixer in a detector or as part of an array-detector system. Also, as the transducer is fabricated using lithographic techniques this permits the fabrication of groups of apertures for the electron beam generated by the field emitter array. The spacing between the apertures can be selected (for example $\lambda/2$) to provide power combination effects within the cavity itself.

BRIEF DESCRIPTION OF DRAWINGS

An embodiment of the present invention will now be described by way of example with reference to the accompanying drawings, in which.

DETAILED DESCRIPTION OF THE INVENTION

Figure 1:
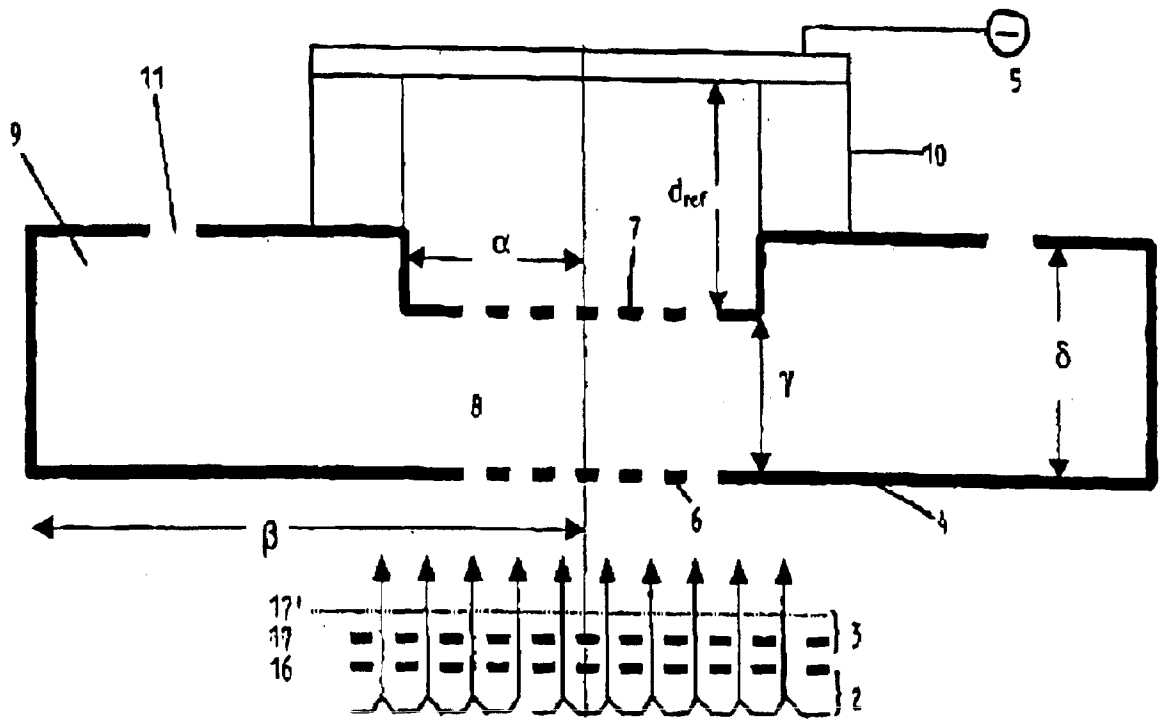
FIG. 1 is a schematic sectional diagram of a generator in accordance with the present invention.

In FIG. 1 a terahertz generator is shown intended for operation at 500 GHz. This frequency coincides with the absorption frequency of BrO which is an important molecule in the chemistry of ozone layer depletion and is also appropriate for other communications applications. The generator has a cold cathode source 2 in the form of a field emitter array which has diamond-coated silicon or molybdenum tips or any other suitable field emitter structure. A focusing system 3 consisting of conventional miniaturised electro-optics focuses the electrons generated by the field emitter array 2 onto a first wall of a micro-machined resonant cavity 4. The resonant cavity is based on a conventional reflex klystron structure and thus requires the incident electrons to pass through the cavity and be reflected back into the cavity by a negatively charged reflector 5. The first wall of the resonant cavity 4 has a grid arrangement in the form of a first array of apertures 6 through which the electrons emitted by the field emitter array pass into the cavity. A second opposing wall of the resonant cavity has a similar second array of apertures 7 through which the electrons pass from the cavity to the reflector 5 and from the reflector back to the cavity. The reflector 5 may be a gold-plated disc of photoresist material, biased to around −100 v, that is aligned substantially parallel to the arrays of apertures 6 and 7.

The resonant cavity 4 consists of an inner generally cylindrical region 8 of radius $\alpha$ bounded on two opposing sides by the first and second arrays of apertures 6 and 7 with the two arrays being separated by a distance $\gamma$, being the depth of the cylinder region B. The cylindrical region 8 communicates with an outer torus region 9 of radius $\beta$. The torus region 9 has a depth $\delta$ that is greater than the depth $\gamma$ of the inner cylindrical region. The walls of the resonant cavity 4 provide an equipotenial surface for electron passage through the cavity.

The reflector 5 is located a distance $d_{ref}$ beyond the second array of apertures 7 and is separated from the second wall of the cavity by an insulator block 10. Thus, a second generally cylindrical cavity is bounded by the second wall of the resonant cavity, the reflector and the insulator block. The reflector structure geometry may be adjusted to improve performance, however, it is essential that the production of ions at the reflector is minimised through the presence of a hard vacuum in the generator.

Power is extracted from the cavity using a slot antenna 11. The slots of the antenna 11 are located in the second wall of the cavity outside of the second array of apertures 7 and are thus substantially parallel to the arrays of apertures 6, 7 and in a plan intersecting the path of the electron beam. The slot antenna may be seen more clearly in FIG. 2. Alternative output couplers to the slot antenna may, of course, be used. It will be immediately apparent that, unlike conventional reflex klystrons, the transducer of FIG. 2 involves vertical emission of radiation from the resonant cavity 4.

The frequency of the output radiation is essentially determined by the cavity dimensions. In order to achieve terahertz frequencies the resonant cavity must be constructed to sizes that are not possible using conventional milling technology. For the re-entrant resonant cavity of FIGS. 1 and 2 a standard analysis for klystron structures may be employed to determine estimates of the necessary sizes to achieve cavity operation at a desired frequency. This analysis produces the measurements given in the following Table for chosen frequencies of 300 GHz, 500 GHz and 1 THz:

| | First Example | Second Example | Third Example |
|---|---|---|---|
| Frequency | 300 GHz | 500 GHz | 1 THz |
| α | 50 μm | 75 μm | 16 μm |
| β | 135 μm | 150 μm | 45 μm |
| γ | 5 μm | 5 μm | 1.7 μm |
| δ | 100 μm | 30 μm | 33 μm |

In the above Table β=cavity radius, cavity height (depth) δ=cavity height (depth), α=radius of re-entrant cylinder and δ=the separation of the cavity base from the re-entrant cylinder base. A crucial dimension is the separation of the cavity and the reflector, $d_{ref}$. This dimension bears upon the bunching characteristics of the electrons in the beam, which in turn relates to the efficiency of power transfer from the electron beam to the cavity. A simple ballistic analysis yields: $d_{ref} >> V_{ref} \times 2 \times 10^{-7}$ n, where n is an integer and $V_{ref}$ is the reflector potential. It is advantageous to operate this generator with n=1; this prevents space charge interactions which would arise from bunches of electrons passing each other in the reflector space. This criterion is fulfilled comfortably using an electrically insulated separator of 50 μm thickness with $V_{ref}$=250 v. Some tuning of the output frequency is possible through adjustment of $V_{ref}$.

Using present cold cathode technology it is envisaged that a tip density of $3 \times 10^4$ tips $mm^{-2}$ for gated arrays or $2 \times 10^5$ tips $mm^{-2}$ for ungated arrays is employed. This results in approximately 300–2000 tips generating electrons which pass through the apertures 7. Since each tip provides about 1 μA of current with a potential of 100 v, a beam power of 30–200 mW can be estimates for cw operation. The efficiency of conventional klystrons is around 5–10% with the generator described above operating at a similar efficiency, a terahertz frequency output power of a few mW is achievable in favourable circumstances.

Figure 2:
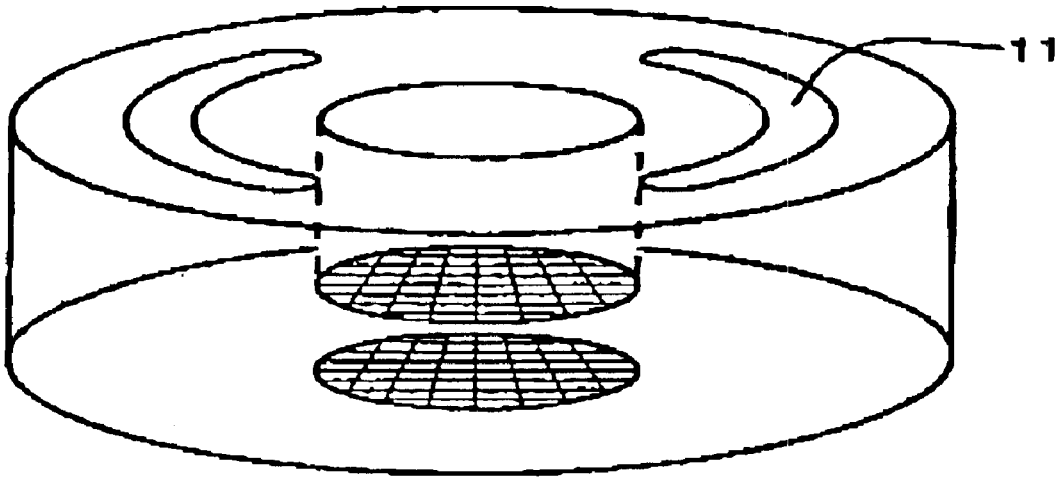
FIG. 2 is a schematic perspective illustration of the generator of FIG. 1.
Figure 3A:
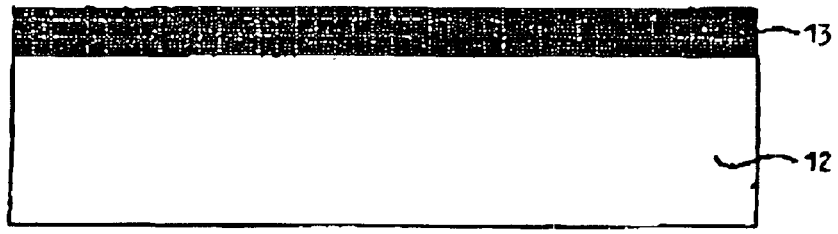
FIGS. 3*a* to 3*d* diagrammatically show a method of fabricating a field emitter array in accordance with the present invention.
Figure 3B:
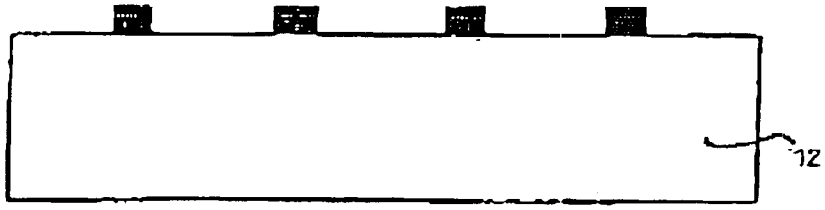
Figure 3C:
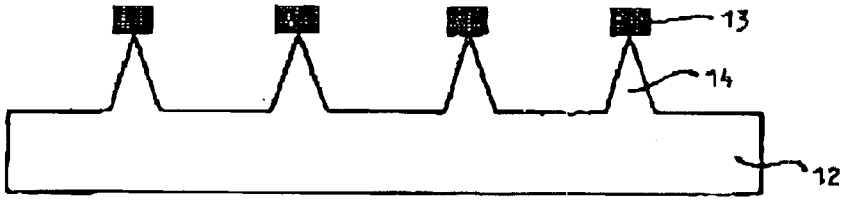
Figure 3D:
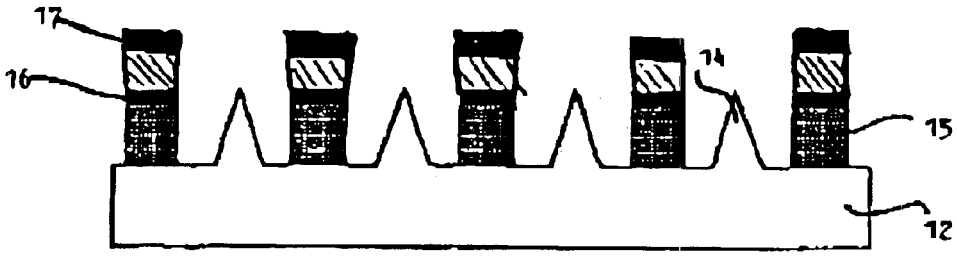
Figure 4A:
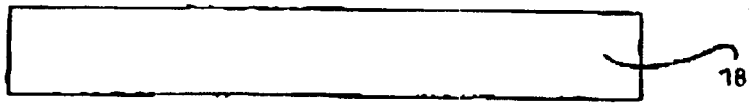
FIGS. 4*a* to 4*k* diagrammatically show a method of fabricating a hollow cavity for use with a generator in accordance with the present invention.
Figure 4B:
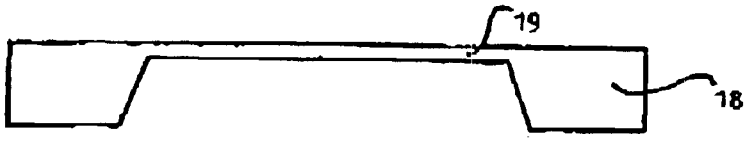
Figure 4C:
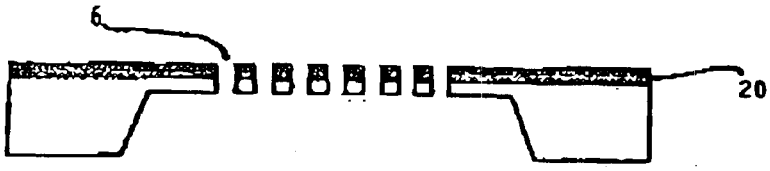
Figure 4D:
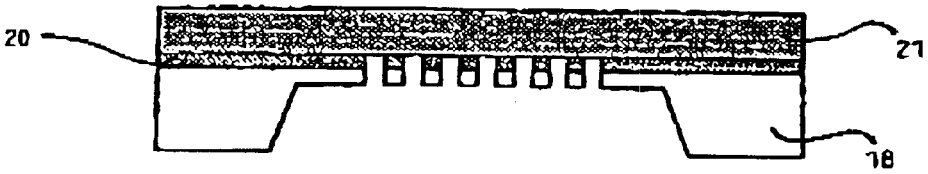
Figure 4E:
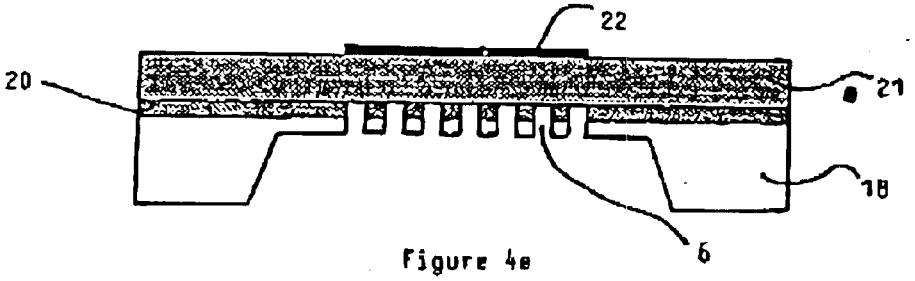
Figure 4F:
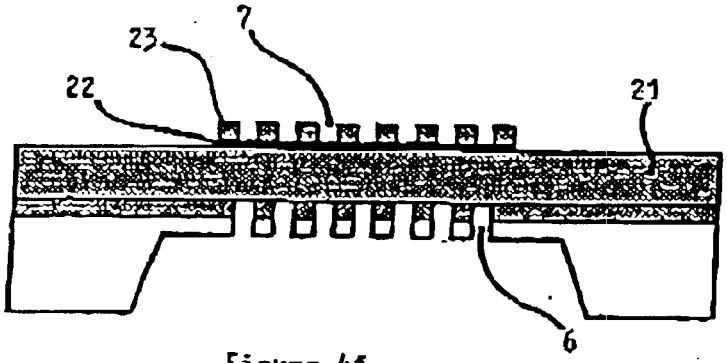
Figure 4G:
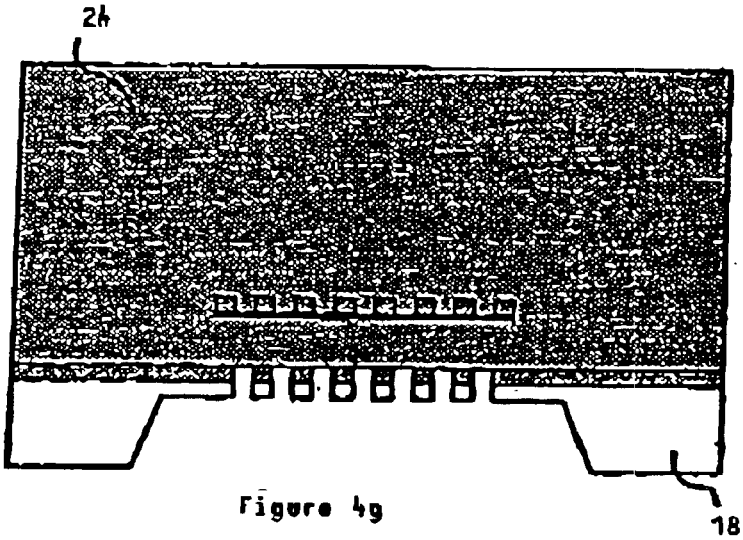
Figure 4H:
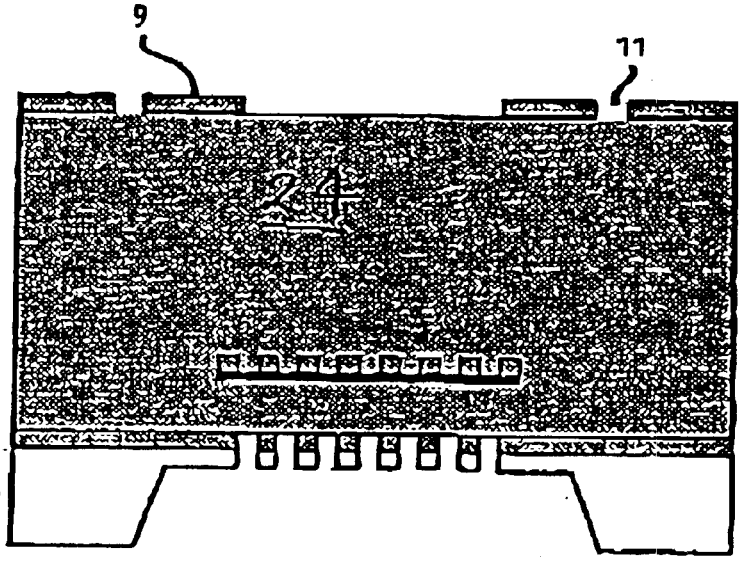
Figure 4I:
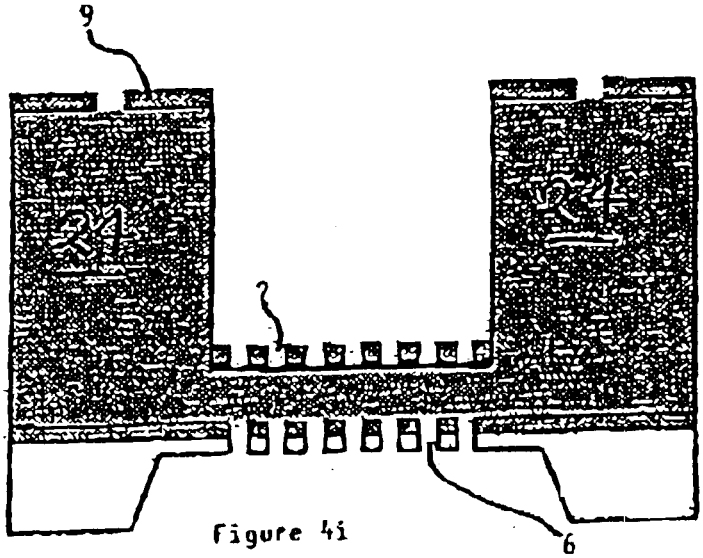
Figure 4J:
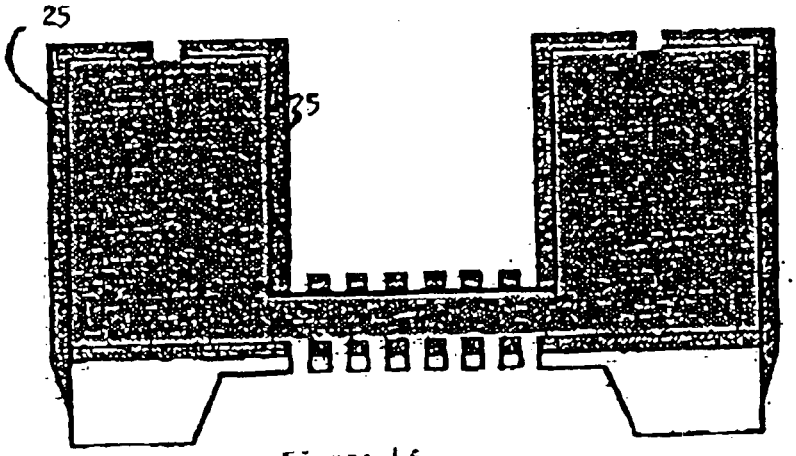
Figure 4K:
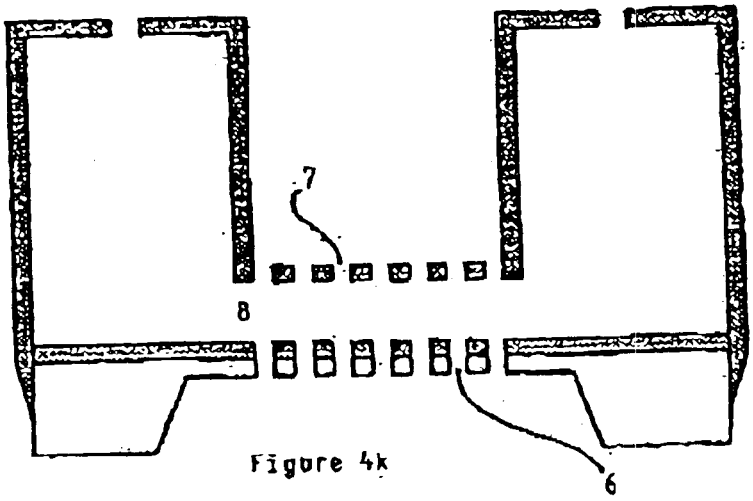

The following is a description of the construction of the terahertz generator of FIGS. 1 and 2. The generator is constructed on a semiconductor substrate 1 using lithographic techniques. In practice, a plurality of generators would be built on the same substrate possibly with as many as 10–100 separate structures. Once all of the generators are fabricated, the entire substrate with the plurality of generators is encapsulated to ensure a hard vacuum. As the generators are arranged for vertical emission, an additional lens arrangement may be encapsulated with the generators and mounted above the plurality of generators so that the power of each of the generators can be combined.

Firstly, the field emitter array 2 is fabricated using known techniques as described below with reference to FIGS. 3*a* to 3*d*. A substrate 12 of silicon, usually in the form of a silicon water, has a layer of silicon oxide 13 grown on its upper surface. A first mask (not shown) is used to pattern the oxide by etching silicon dioxide exposed through the first mask as far as the silicon wafer beneath. After this first etch, the remaining regions of silicon oxide form an etch mask for the fabrication of the emitter tips. The silicon wafer is etched through the silicon oxide etch mask using conventional techniques so that undercut regions are formed beneath each of the silicon oxide mask regions. The undercut regions form sharp peaks 14 that are the emitters for the field emitter array 2. Finally, gate insulation 15 and gate metallisation structures 16, 17 are fabricated between each of the emitter tips 14. The first gate 16 is the extractor gate and the second gate 17 acts as the focusing system 3. The first gate 16 is positioned approximately the same height above the surface of the silicon wafer as the emitter tip 14 with the second gate 17 further from the surface of the wafer. By varying the voltage applied to the second gate 17, with respect to the applied voltage of the first gate 16, the focus of the electron beam produced by the emitter tip 14 can be altered. An additional lens arrangement 17' may be provided above the focussing element 17 to further improve focussing of the electron beam.

FIGS. 4*a* to 4*k* exemplify the fabrication of the hollow resonant cavity. The underside of a silicon substrate 18, such as a wafer, is patterned and then etched to form a central thin membrane section 19 with a diameter corresponding to the desired diameter of the array of apertures 6. A metallic layer 20 of titanium or gold for example is then applied over the top surface of the silicon wafer including the central membrane section 19 for example by sputter coating. The central membrane section and the covering metallic layer 20 is then etched using conventional techniques to form a first array of apertures 6 that extend through the metallic layer and the underlying membrane 19 of silicon.

A layer of resist is 21 then spun over the surface of the metallic layer 20 to a thickness corresponding to the desired separation of the first and second apertures 6,7. The resist 21 is a dissolvable polymer such as Hoescht AZ 4000, for example. A sacrificial layer of aluminium 22 is then applied over the surface of the resist 21 and etched so that the aluminium only extends over a region approximately corresponding to the membrane region of the silicon wafer. The upper surface of the resist 21 and the aluminium 22 is then sputter coated, for example with gold or titanium to form a metallic layer 23 that is subsequently etched to form a central region containing the second array of apertures 7. This second metallic layer 23 may also be built up to improve its mechanical strength using electroplating. A further thick layer of resist 24 is then deposited over the surface of the second metallic layer 23 and the surrounding resist 21. This second layer of resist is laid down to a thickness corresponding to the desired height of the outer torus 9.

Next, using the same metallisation techniques, as described above, the top surface of the outer torus 9 is formed including the slot antennas 11 over the top surface of the second layer of resist 24. The second layer of resist 24 is then etched, in the region within the torus 9, as far as the. second array of apertures 7. This etching step is preferably performed by cyclically exposing and removing successive exposed regions of the resist so as to ensure the necessary high aspect ratio etching. During each cycle it may prove necessary to initially ash a thin layer of the upper surface of the exposed resist that may have been over-exposed.

Using a multiple source evaporation technique, gold/titanium walls 25 are built up over the outer surfaces of the resist. The walls are preferably electroplated with copper for additional mechanical strength. Next, an acetone wash is used to remove the remaining resist to form the cavity 8. Finally, the sacrificial aluminium 22 is etched using a conventional technique to completely clear the inside of the cavity 8.

Using similar method steps to those described above, a layer of dissolvable polymer (not shown) is applied over the top of the second array of apertures 7 to a height above the upper surface of the torus 9. The insulating wall 10 is then fabricated about the layer of dissolvable polymer so that the insulating wall 10 extends upwards from the upper surface of the torus 9 and finally a layer of photoresist is applied over the upper surface of the dissolvable polymer to form the reflector 5. The dissolvable polymer is then removed using the same technique as described above to form a cavity between the second array of apertures 7 and the reflector 5.

Thus, it can be seen that the layers of resist are lithographically etched in turn to produce a series of formers of the desired structure of different parts of the hollow cavity and that the walls of the generator are constructed by metallising the shaped surfaces of the resist.

With the invention described above terahertz signals are generated that will enable faster signal processing and communications to be achieved. Also, the terahertz generator can be used to achieve higher resolution spectroscopy such as in the identification of atmospheric pollutants and in the monitoring food quality, to perform atmospheric and astrophysical remote sensing and to perform imaging (including medical and dental imaging) with unique contrast mechanisms.

As the electron source for the generator is a field emitter array this results in less spread in the energy of the electrons in the beam than would be the case for thermionic emitters. An electron energy spread of the order of 0.2 electron volts is expected rather than energy spreads of the order of 1.0 electron volts for a thermionic emitter. This reduction in the energy spread is particularly important for generators at terahertz frequencies because of the need to control any slight fluctuations in the beam current in view of problem associated with thermal noise. Furthermore, the field emitter array may be constructed so that the spacing between groups of individual tips is of the order of the wavelength of the terahertz radiation. This means that a spatially distributed electron beam can be employed and that the beam can be profiled to better match the characteristics of the resonant cavity. This latter advantage is likely to be of particular benefit in imaging applications for medicine and other uses.

As the resonant cavity is constructed using micro-machining techniques far more complex structures can be produced than has formerly been the case. Furthermore, associated structures can be integrally fabricated with the transducer itself, as can the electronic components since the structures are fabricated on a conventional substrate. Indeed, where necessary, electronic components can be suspended within cavities constructed using this micro-machining technique.

Although the present invention has been described with reference to a generator employing a klystron structure, it will be appreciated that other devices may be constructed in accordance with the present invention such as magnetrons, travelling wave tubes and travelling wave amplifiers. In all cases though as micro-machining techniques using semiconductor photoresist are employed in the construction of the devices, terahertz frequencies can be achieved at low cost. For example, the fabrication method described above may be employed in the production of klystrons with separate input and output cavities or klystrons in which the resonant cavities are replaced by waveguides. Slow wave structures such as forward or backward wave amplifiers also may be fabricated using his method.

What is claimed is:

1. A method of fabricating a transducer comprising the steps of:

providing a field emitter array for generating a beam of electrons;

constructing a hollow cavity having one or more first apertures in a wall of the hollow cavity and an output for electromagnetic radiation; and positioning the hollow cavity such that the one or more apertures intersect the beam of electrons from the field emitter array, the cavity having metallic walls constructed using a polymeric material that is etched to produce a former of the desired shape of at least part of the cavity.

2. A method as claimed in claim 1, wherein the hollow cavity is constructed using a plurality of formers each fabricated to define different regions of the cavity.

3. A method as claimed in claim 1 or 2, wherein the walls of the hollow cavity are constructed by: coating the exposed surfaces of the one or more formers with a metallic material; etching the metallic coatings; and subsequently dissolving the one or more formers leaving the desired hollow metallic structure.

4. A method as claimed in claim 3, wherein the metallic coatings are electroplated to provide additional mechanical strength.

5. A method as claimed in claim 1, wherein the polymeric material is a photoresist.

6. A method as claimed in claim 5, wherein the former is produced by lithographically etching the photoresist to the desired shape.

7. A method of fabricating a transducer as claimed in claim 1, further including the step of providing one or more second apertures in the hollow cavity, opposite the one or more first apertures, and mounting a reflector on the outside of the hollow cavity beyond the one or more second apertures.

8. A method of fabricating a transducer as claimed in claim 7, further including providing an electrically insulating wall on the outside of the hollow cavity about the one or more second apertures on which the reflector is mounted.

9. A method of fabricating a transducer as claimed in claim 1, wherein the output for electromagnetic radiation is provided in a wall of the hollow cavity opposite the wall in which the one or more first apertures are located.

10. A method of fabricating a transducer as claimed in claim 9, wherein the output is in the form of a slot antenna.

11. A transducer comprising a field emitter array for providing a beam of electrons and a hollow cavity having one or more first apertures located so as to intersect the beam of electrons from the field emitter array and an output for electromagnetic radiation wherein the hollow cavity has metallic walls constructed about a removable former of etched polymeric material.

12. A transducer as claimed in claim 11, wherein the output for electromagnetic radiation is located in a wall of the hollow cavity opposite the wall having the one or more first apertures such that emission of the electromagnetic radiation is in a direction substantially parallel to the beam of electrons from the field emitter array.

13. A transducer as claimed in claim 11, further including one or more second apertures in the hollow cavity, opposite the one or more first apertures, and a reflector mounted on the outside of the hollow cavity beyond the one or more second apertures.

14. A transducer as claimed in claim 13, further including an electrically insulating wall provided on the outside of the hollow cavity about the one or more second apertures on which the reflector is mounted.

15. A transducer as claimed in claim 11, wherein the output is in the form of a slot antenna.

16. A transducer as claimed in claim 11, wherein the transducer generates electromagnetic radiation in the frequency range 300 GHZ to 10 THz.

* * * * *